US007914173B2

(12) United States Patent
Paulussen et al.

(10) Patent No.: US 7,914,173 B2
(45) Date of Patent: Mar. 29, 2011

(54) LAMP ASSEMBLY

(75) Inventors: Elvira Johanna Maria Paulussen, Eindhoven (NL); Peter Alexander Duine, Eindhoven (NL); Denis Joseph Carel Van Oers, Eindhoven (NL)

(73) Assignee: Koninlijke Philips Electronics N.V., Eindhoven (NL)

( * ) Notice: Subject to any disclaimer, the term of this patent is extended or adjusted under 35 U.S.C. 154(b) by 166 days.

(21) Appl. No.: 12/093,463

(22) PCT Filed: Nov. 13, 2006

(86) PCT No.: PCT/IB2006/054222

§ 371 (c)(1), (2), (4) Date: May 13, 2008

(87) PCT Pub. No.: WO2007/057834

PCT Pub. Date: May 24, 2007

(65) Prior Publication Data

US 2008/0253119 A1 Oct. 16, 2008

(30) Foreign Application Priority Data

Nov. 17, 2005 (EP) ..... 05110865

(51) Int. Cl.
*F21V 5/00* (2006.01)

(52) U.S. Cl. ... 362/245; 362/231; 362/247; 362/249.02; 362/296.01

(58) Field of Classification Search ..... 362/231, 362/245, 247, 249.02, 294, 296.01, 373
See application file for complete search history.

(56) References Cited

U.S. PATENT DOCUMENTS

| | | | | |
|---|---|---|---|---|
| 6,334,700 | B2 | 1/2002 | Ramer et al. | |
| 7,018,062 | B2 * | 3/2006 | Taylor | 362/101 |
| 2003/0076034 | A1 | 4/2003 | Marshall et al. | |
| 2003/0185005 | A1 | 10/2003 | Sommers et al. | |
| 2005/0225985 | A1 | 10/2005 | Catalano et al. | |

FOREIGN PATENT DOCUMENTS

| | | | |
|---|---|---|---|
| EP | 0416253 | A2 | 3/1991 |
| EP | 1594172 | A2 | 11/2005 |
| WO | WO0113437 | A1 | 2/2001 |
| WO | WO2005105381 | A2 | 11/2005 |

* cited by examiner

*Primary Examiner* — Sandra L O Shea
*Assistant Examiner* — Meghan K Dunwiddie

(57) ABSTRACT

The invention relates to a lamp assembly for illuminating a surface comprising a cavity (5) having a substantially diffuse reflective surface (6), said cavity having an open aperture (7) facing said surface to be illuminated, and a plurality of light emitting diodes (9A, 9B, 9C) capable of emitting visible light ($L_A$, $L_B$, $L_C$). The light emitting diodes are arranged on or near said diffuse reflective surface of said cavity such that light emitted from said light emitting diodes is capable of reflecting from said diffuse reflective surface towards said surface to be illuminated.

6 Claims, 3 Drawing Sheets

LAMP ASSEMBLY

FIELD OF THE INVENTION

The invention generally relates to a lamp assembly. More specifically, the invention relates to a lamp assembly capable of illuminating a surface by a plurality of light emitting diodes.

BACKGROUND OF THE INVENTION

Light sources are frequently applied in several types of atmosphere and ambience lighting applications for creating mood in e.g. a living room. More and more, these light sources comprise a plurality of light emitting diodes (LEDs), which can emit different colors. Mixing of colors and collimation of the light beams are particularly relevant issues for these lighting applications.

U.S. Pat. No. 6,334,700 discloses a direct view lighting system with a constructive occlusion providing a tailored radiation intensity distribution adapted to meet the requirements of certain special applications. Some radiant energy from the system source reflects and diffuses within the volume between a mask and a cavity. The mask constructively occludes the aperture of the cavity. The reflected energy emerging from between the mask and cavity provides a desired illumination for regions not covered by the direct illumination.

A problem of the prior art lamp assembly is that the mask of the assembly obstructs a considerable portion of the light having diffusely reflected once from the surface of the cavity. Consequently, only limited regions can be illuminated by the light beams reflected from the surface of the cavity.

SUMMARY OF THE INVENTION

It is an object of the invention to provide an improved lamp assembly.

To this end, a lamp assembly is provided for illuminating a surface comprising a cavity having a substantially diffuse reflective surface, said cavity having an open aperture facing said surface to be illuminated, and a plurality of light emitting diodes capable of emitting visible light. The light emitting diodes are arranged on or near said diffuse reflective surface of said cavity such that light emitted from said light emitting diodes is capable of reflecting from said diffuse reflective surface towards said surface to be illuminated.

By providing the lamp assembly with a cavity with an open aperture and arranging the light sources in close proximity to the diffuse reflective surface of the cavity, no obstructions are present for light reflected from the diffuse reflective surface of the cavity to illuminate a surface. Since the diffuse reflective surface of the cavity efficiently mixes the light emitted from the various LEDs, a uniform and, for LEDs emitting colored light, color-mixed light beam is obtained to illuminate a surface.

The embodiment of the invention as defined in claim 2 provides the advantage that side light emitting diodes considerably increase the amount of light directed from the diodes towards the diffuse reflective surface of the cavity and substantially reduces or eliminates the amount of light from these diodes that directly illuminate the surface. Consequently, the uniformity or color mixing of the light, which results in reflection from the diffuse reflective surface, is improved.

The embodiment of the invention as defined in claim 3 provides the advantage that the surface can be illuminated in a colored fashion. The diffuse reflective surface of the cavity provides for efficient color mixing in this embodiment.

The embodiment of the invention as defined in claim 4 provides the advantage that for LEDs emitting light of the same color, variations in light flux and color between individual LEDs around average values (also referred to as binning) can be (partly) compensated.

The embodiment of the invention as defined in claim 5 provides the advantage that color mixing and beam shape can be tuned by these shapes of the cavity.

The embodiment of the invention as defined in claim 6 provides the advantage that the plurality of LEDs are arranged in the cavity in a suitable manner such that the diffuse reflective surface of the cavity is present all around the LEDs to accomplish the uniform and color-mixed illumination of the surface.

The invention will be further illustrated with reference to the attached drawings, which schematically show preferred embodiments according to the invention. It will be understood that the invention is not in any way restricted to these specific and preferred embodiments.

DETAILED DESCRIPTION OF THE DRAWINGS

Figure 1:
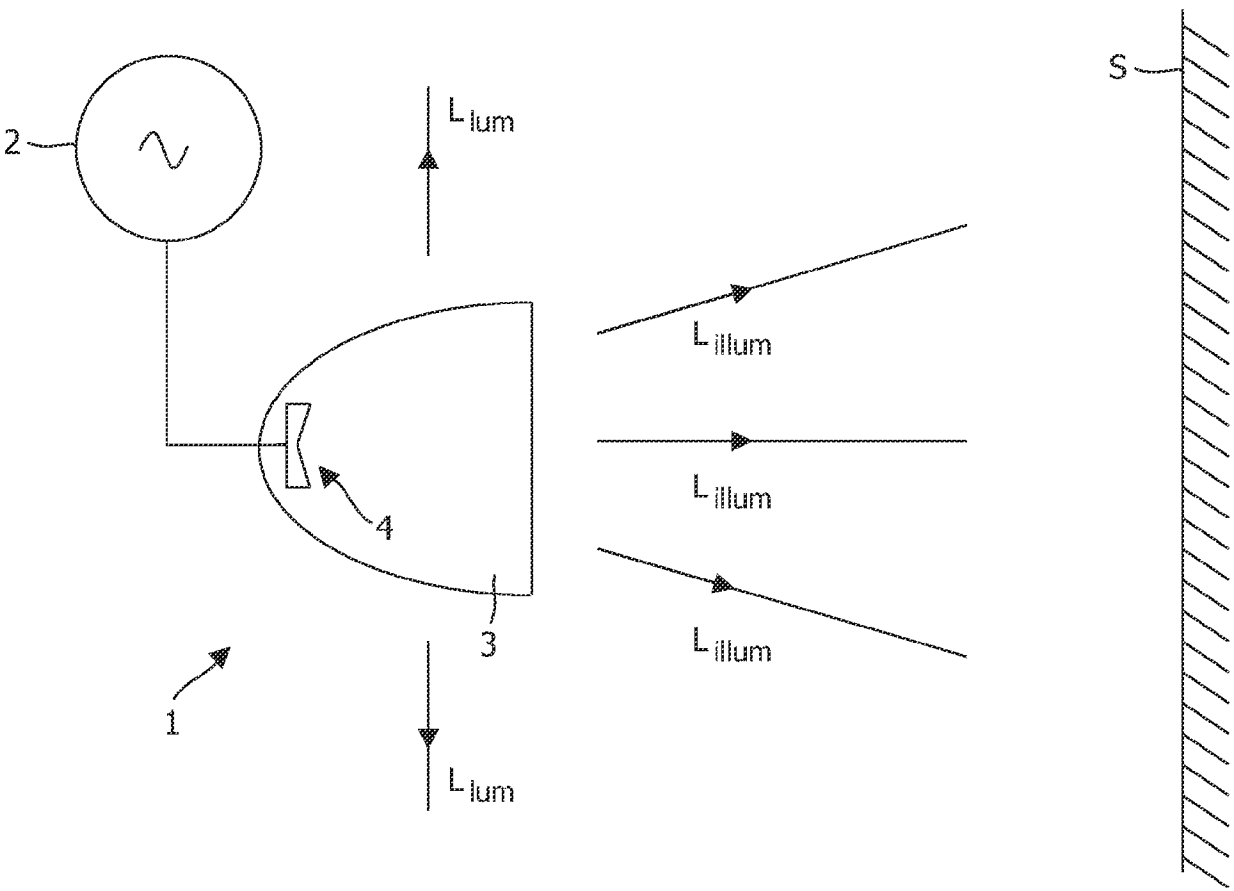
FIG. 1 illustrates a lamp assembly illuminating a surface according to an embodiment of the invention.

FIG. 1 illustrates a lamp assembly 1 illuminating a surface S. The lamp assembly is connected to a power supply 2 and comprises a light transmitting chamber 3 accommodating a lighting means 4. The chamber 3 may e.g. be of plastic and comprise light scattering particles. The chamber 3 is open towards the surface S such that a large amount of the light B originating from the lighting means 4 is directed towards the surface S. As an example, 90% of the light may be directed towards the surface S (indicated by the arrows $L_{illum}$), whereas 10% of the light accounts for luminance of the chamber 3 through its light transmitting walls (indicated by the arrows $L_{lum}$). However, it should be appreciated that the walls of the chamber 3 may also (partly) comprise a reflective surface to increase the amount of light arriving at the surface S.

The lighting means 4 will now be discussed in further detail with reference to FIGS. 2*a* and 2*b*.

Figure 2B:
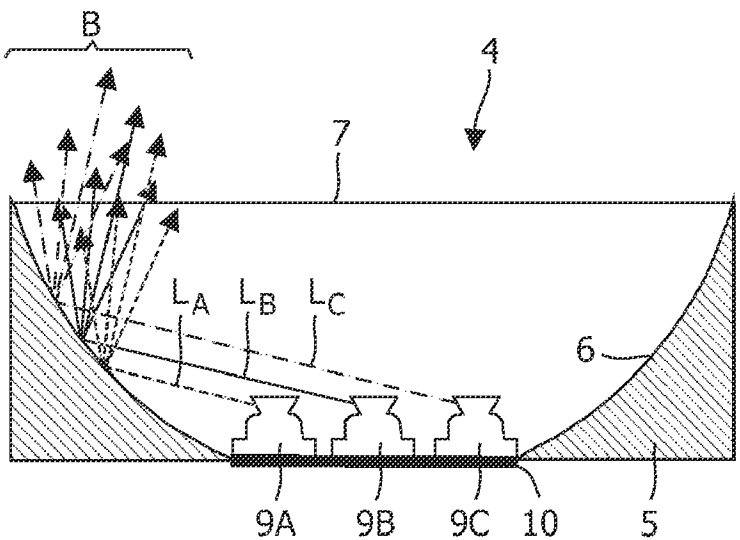
FIGS. 2*a* and 2*b* show a schematic illustration in cross-section of a portion of the lamp assembly of FIG. 1.
Figure 2A:
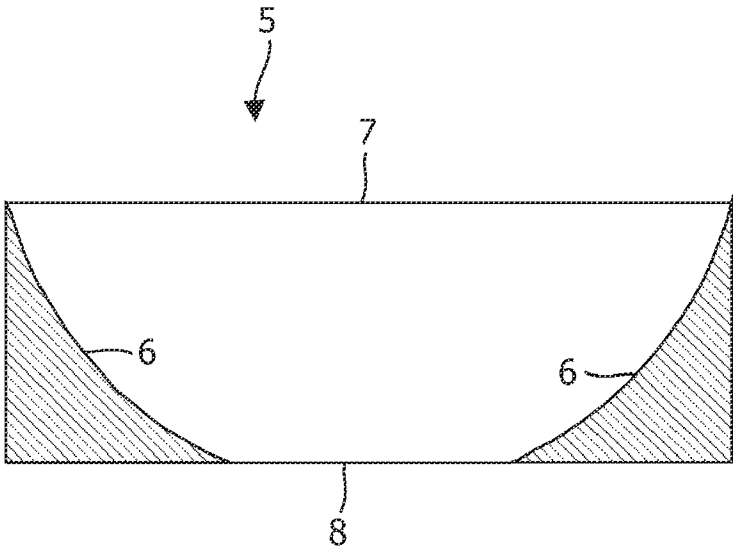

The lighting means 4 comprises a cavity 5, shown in FIG. 2*a*, having a substantially diffuse reflective surface 6. The surface 6 may e.g. be a processed surface of a body constituting the cavity 5 or a coating with the required diffuse reflective characteristics. The cavity may comprise a metallic body, e.g. of aluminum. The diffuse reflective surface may e.g. have a reflectivity higher than 95%. As an example, the diffuse reflective surface 6 may be formed of a spray-coated white paint. Also, a thin white plastic cup in e.g. an aluminum cup may qualify.

The cavity 5 has an aperture 7 facing the surface S to be illuminated. The aperture may be provided with a diffuser, for example a sand-blasted glass plate, a diffusing foil or a synthetic volume diffuser.

Furthermore, the cavity 5 has an opening 8 near the lowest point of the cavity 5 for accommodating light emitting diodes 9A, 9B, 9C (LEDs) arranged on a substrate 10 and capable of emitting visible light, as shown in FIG. 2*b*. The LEDs 9A, 9B, 9C may either all be capable of emitting light of the same color or emit light of different colors, e.g. red, green and blue light. As an example, the lamp assembly 1 may comprise five LEDs (only three of which are shown in the cross-section of FIG. 2*b*) in a circular arrangement. The LEDs 8A, 8B, 8C each may e.g. have a power of 1-3 Watts.

The LEDs 9A, 9B, 9C are arranged near the diffuse reflective surface 6 of the cavity 5 by inserting the LEDs 9A, 9B, 9C through the opening 8. As the LEDs 9A, 9B, 9C are side emitting diodes, the majority of the light emitted from the LEDs 9A, 9B, 9C is directed towards the surface 6 and capable of reflecting from the diffuse reflective surface 6 towards the surface S to be illuminated.

The side light emitting diodes 9A, 9B, 9C are preferably high brightness LEDs, such as Luxeon™ diodes of LumiLeds.

In operation of the lamp assembly 1, each of the colored LEDs 9A, 9B, 9C generates light $L_A$, $L_B$, $L_C$ indicated by a dark gray, black and light gray ray respectively. Each ray $L_A$, $L_B$, $L_C$ reflects from the surface 6 in a diffuse fashion towards the aperture 7 of the cavity 5. Consequently, the light emitted from the LEDs 9A, 9B, 9C is mixed already to a large extent within the cavity 5 and uniform and color-mixed beam B results. The mixed light may leave the cavity 5 at substantially any position in the aperture 7 as the aperture 7 is not blocked by an occlusion as in the prior art. It should be appreciated, however, that color mixing may improve even further after the beam B has left the cavity 5.

The cavity 5 may comprise a metallic body capable of transferring heat generated by the LEDs 9A, 9B, 9C and/or the substrate 10 away from this location.

The internal shape of the cavity 5, i.e. the shape of the diffuse reflective surface 6 may for instance be a cylindrical, conical, parabolic or oval cross-sectional shape. The shape of the cavity 5 determines the amount of color mixing and the shape of the beam B. Tuning the amount of color mixing and the beam shape is a trade-off and priority may be given to one of these features.

The color-mixed beam B is projected on the surface S as a color mixed spot, indicated by the arrows $L_{illum}$ in FIG. 1. A portion of the beam B may be used for obtaining a luminance effect for the lamp assembly 1, indicated by the arrows $L_{lum}$ in FIG. 1.

Figure 3:
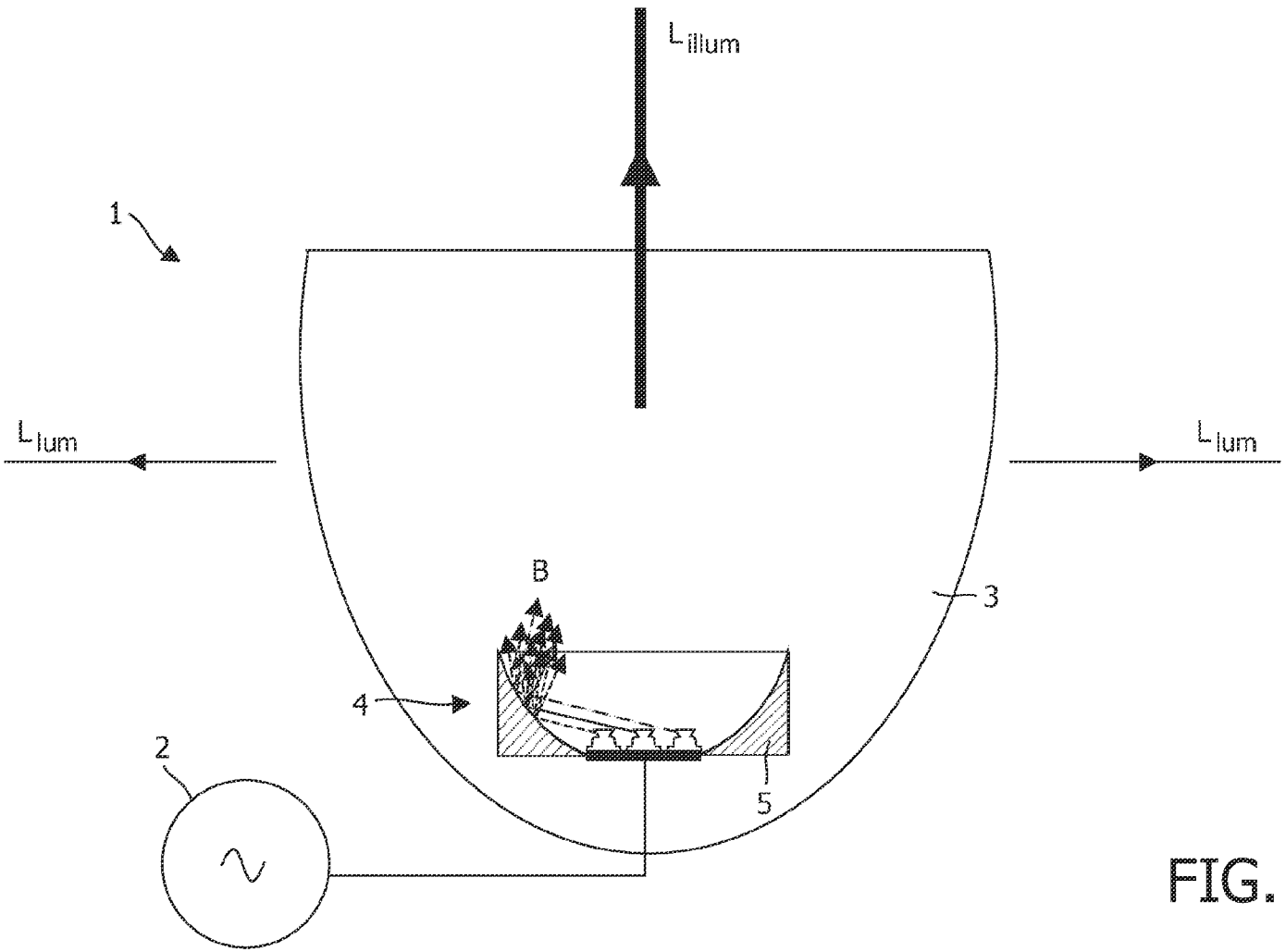
FIG. 3 shows a lamp assembly comprising the lighting means of FIG. 2*b*.

Finally, in FIG. 3, the lighting means 4 of FIG. 2*b* has been shown in combination with the power supply 2 and light transmitting chamber 3. For reasons of clarity, only a few reference numerals indicated in FIG. 2*b* have been inserted in FIG. 3.

In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The mere fact that certain measures are recited in mutually different dependent claims does not indicate that a combination of these measures cannot be used to advantage.

The invention claimed is:

1. A lamp assembly for illuminating a surface comprising:

a chamber opened toward said surface and having light transmitting walls;

a lighting means disposed within said chamber and comprising:

a body defining a cavity having a substantially diffuse reflective surface, said cavity having an aperture facing said surface and an opening opposing said aperture; and a plurality of light emitting diodes for emitting visible light disposed within said opening proximate to said substantially diffuse reflective surface of said cavity such that the light emitted from said light emitting diodes reflects from said substantially diffuse reflective surface towards said surface to be illuminated.

2. The lamp assembly according to claim 1, wherein said plurality of light-emitting diodes comprises side light emitting diodes.

3. The lamp assembly according to claim 1, wherein said plurality of light-emitting diodes comprises diodes emitting visible light of a first color and diodes emitting visible light of a second color.

4. The lamp assembly according to claim 1, wherein said plurality of light-emitting diodes emit visible light of the same color.

5. The lamp assembly according to claim 1, wherein said cavity has a cylindrical, cone or oval shape.

6. The lamp assembly according to claim 1, wherein said body comprises a metallic body thermally coupled to said plurality of light emitting diodes, and having coating forming said substantially diffuse reflective surface.

* * * * *